US009267699B1

(12) United States Patent
Souza

(10) Patent No.: US 9,267,699 B1
(45) Date of Patent: Feb. 23, 2016

(54) VENT PIPE CAP

(71) Applicant: Gerald W. Souza, Honolulu, HI (US)

(72) Inventor: Gerald W. Souza, Honolulu, HI (US)

( * ) Notice: Subject to any disclaimer, the term of this patent is extended or adjusted under 35 U.S.C. 154(b) by 672 days.

(21) Appl. No.: 13/661,449

(22) Filed: Oct. 26, 2012

(51) Int. Cl.

| | |
|---|---|
| ***F23J 13/08*** | (2006.01) |
| ***F24F 7/02*** | (2006.01) |
| ***B66C 23/06*** | (2006.01) |
| ***E04B 7/00*** | (2006.01) |
| *F24F 11/00* | (2006.01) |

(52) U.S. Cl.
CPC ..... *F24F 7/02* (2013.01); *F24F 2011/0095* (2013.01)

(58) Field of Classification Search
USPC ..... 454/4–5, 8, 35, 250, 252, 364–368; 52/119, 199
IPC ..... F24F 7/02,2011/0095; F23J 13/08, F23J 2900/13, 2213/50; F24C 15/002
See application file for complete search history.

(56) References Cited

U.S. PATENT DOCUMENTS

| | | | | |
|---|---|---|---|---|
| 293,526 | A | 2/1884 | Scholl | |
| 972,378 | A * | 10/1910 | Huffmsn | 454/4 |
| 1,340,033 | A | 5/1920 | Fojtik | |
| 1,452,259 | A | 4/1923 | Snell | |
| 3,200,735 | A | 8/1965 | Bergen | |
| 3,209,669 | A * | 10/1965 | Bayne | 454/368 |
| 3,398,671 | A | 8/1968 | Acosta | |
| 3,579,930 | A | 5/1971 | Murphy | |
| 5,081,914 | A * | 1/1992 | Mejia | 454/367 |
| 5,394,663 | A | 3/1995 | Jackson | |
| 6,954,947 | B1 | 10/2005 | Williams, Jr. | |

* cited by examiner

*Primary Examiner* — Steven B McAllister
*Assistant Examiner* — Helena Kosanovic
(74) *Attorney, Agent, or Firm* — Robert C. Montgomery; Montgomery Patent & Design LP.

(57) ABSTRACT

A protective vent line cap for protecting sanitary plumbing vent lines is described. The vent line cap includes an open bottom conically flared shroud that attaches to the vent line using a mounting strap having an adjustable strap clamp fastener and a mounting bracket. The mounting bracket is fastened at its top to the shroud and at the bottom to the strap clamp. The vent line cap is designed to be easily installed and removed using common hand tools. The vent line cap prevents foreign material from entering the vent line and subjacent plumbing while still allowing air to flow from the vent line as well as preventing rain water from entering sewer system.

10 Claims, 3 Drawing Sheets

VENT PIPE CAP

RELATED APPLICATIONS

There are currently no co-pending applications.

FIELD OF THE INVENTION

The presently disclosed subject matter is directed to plumbing devices. More particularly, the present invention relates to sanitary plumbing vent line caps.

BACKGROUND OF THE INVENTION

Over the last one hundred twenty-five years (125 y.) or so plumbing has developed into a modern engineering marvel. American cities, suburbs and small towns have implemented a maze of plumbing pipes and pumps that both supply users with potable water from water sources and dispose of water borne waste into sewage systems.

The plumbing that removes water borne waste is commonly referred to as the drain-waste-vent (DWV) or sanitary piping system. The sanitary piping system removes sewage and greywater waste from a house or other building. Such waste is produced at toilets, sinks and showers. To prevent the unpleasant smell of sewer gas each sanitary piping fixture is supplied with a water trap, which is a section of pipe, usually containing a "U"-shaped trap filled with water. On one (1) side of the "U" shape traps are waste lines that run to the sewer system while on the other side is living or working spaces. Ideally the water in the "U" shape traps block sewer gas from seeping into the living spaces.

While sanitary piping systems work very well, they do have problems. Sewer gases can build up rather high pressures due to biodegrading sewer matter and other causes. Such pressure can cause sewer gases to escape back through the "U" shape traps. This is easily prevented by simply venting the sanitary piping system to atmospheric pressure using a vent line. A common sight on the roof of almost every home or building is the sanitary piping system vent line. Such vent lines release pressure build-up in the sanitary piping system which aids sewage transfer.

Properly maintained vent lines work very well. However, since the interior of the pipe is completely open to the environment, foreign objects or materials can easily enter. Items such as twigs, leaves, dirt, trash, and the like can fall or be blown inside, while birds, small animals, and insects can fly, crawl, or become trapped inside. Such materials can accumulate within the vent line, causing it to cease operating properly in that air does not freely enter and leave the vent line. This can result in piping backups and flooding. When such occurs the most realistic fix is to go to the roof and remove objects and blockages. A most unpleasant and dangerous task.

Accordingly, there exists a need for a means by which foreign material can be kept out of sanitary pipe vents in an effort to eliminate the problems as described above. Beneficially such a means would be easy to attach using common tools and fasteners and would allow air to readily enter the vent line. Even more beneficially that means would be easily removed to allow access to the vent line if required or if modifications are needed.

SUMMARY OF THE INVENTION

The principles of the present invention provide for vent line caps that keep foreign materials out of vent lines while still allowing air to readily enter and leave the line. Such vent caps are easily attacked using common tools and fasteners and are easily removed if access to the vent line is required or if modifications are needed.

A vent line cap that is in accord with the present invention includes a shroud assembly having an open-bottomed conical side and a generally circular top. The vent line cap further includes a substantially flat strap clamp and an inverted "U"-shaped support bracket having two (2) side legs, each with a bottom strap hook, and an upper horizontal leg that spans between the side legs. The top attaches to the upper horizontal leg while the bottom strap hooks attach to the strap clamp. Beneficially, each strap hook is a "U"-shaped appendage having a narrow vertical slot that is dimensioned to receive and close on the strap clamp as well as a fastener closing each strap hook around the strap clamp to form a rigid union.

The vent line cap preferably includes a strap clamp having an integral screw-type tensioner mechanism that interacts with a plurality of parallel apertures. Ideally the screw-type tensioner mechanism can be tightened or released using a common hand tool such as a screwdriver, a nut driver, a wrench, a crescent wrench, a lock wrench or pliers.

To properly mount the vent line cap on the top of a vent line, the two (2) side legs each include a horizontally protruding stop. In practice the shroud assembly is comprised of molded plastic or a corrosion resistant metal. A top fastener is used to connect the top to the upper horizontal leg. Because of mounting stress the top fastener should include a washer.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
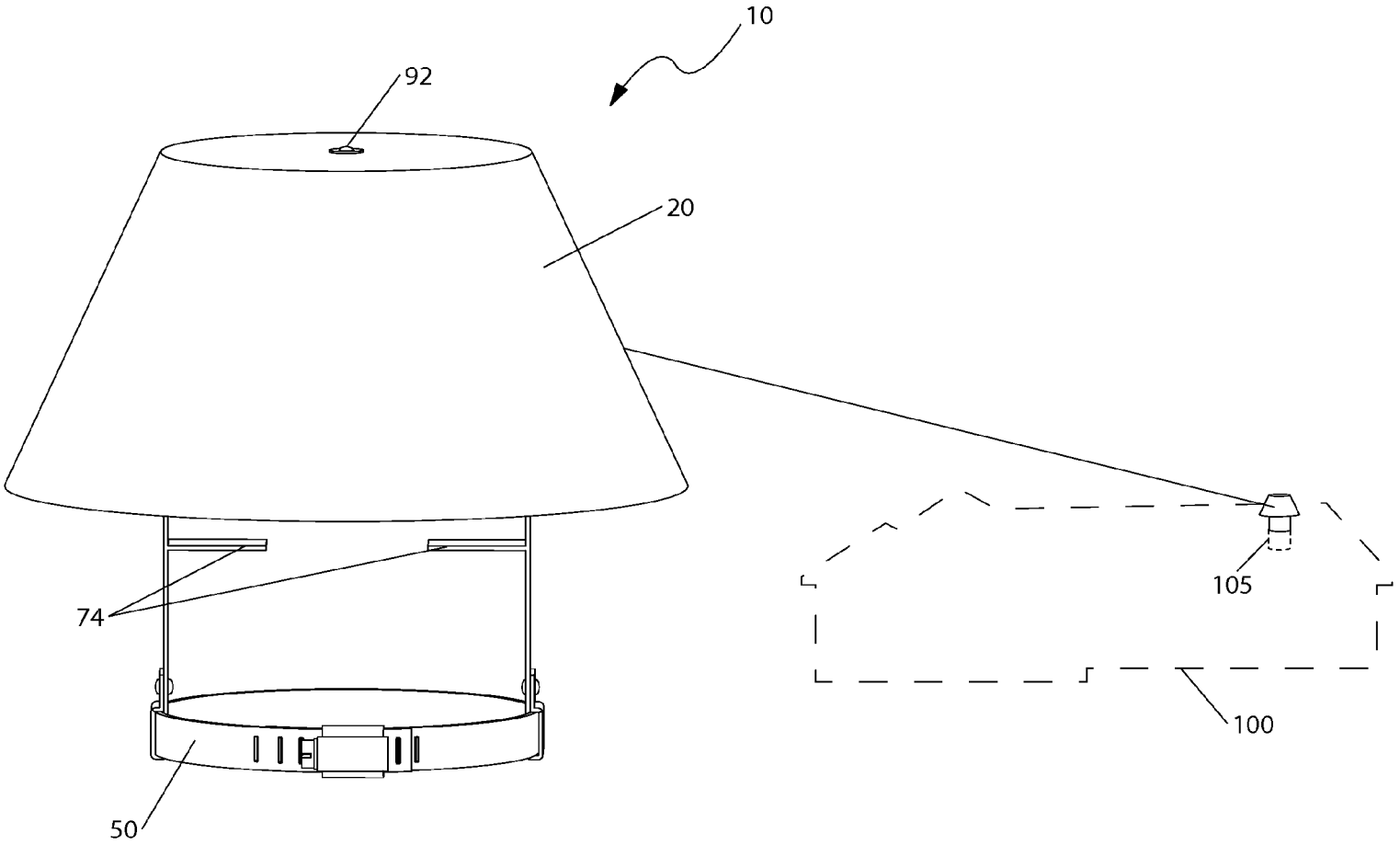
FIG. 1 is an environmental view of a vent line cap 10 that is in accord with the preferred embodiment of the present invention.

10 vent line cap
20 shroud assembly
22 side
24 top
50 strap clamp
52 tensioner mechanism
54 aperture
70 support bracket
72 strap hook
73 side leg
74 stop
75 upper horizontal leg
90 first fastener
92 second fastener
94 washer
100 building structure
105 vent line

DETAILED DESCRIPTION OF THE PREFERRED EMBODIMENT

Figure 2:
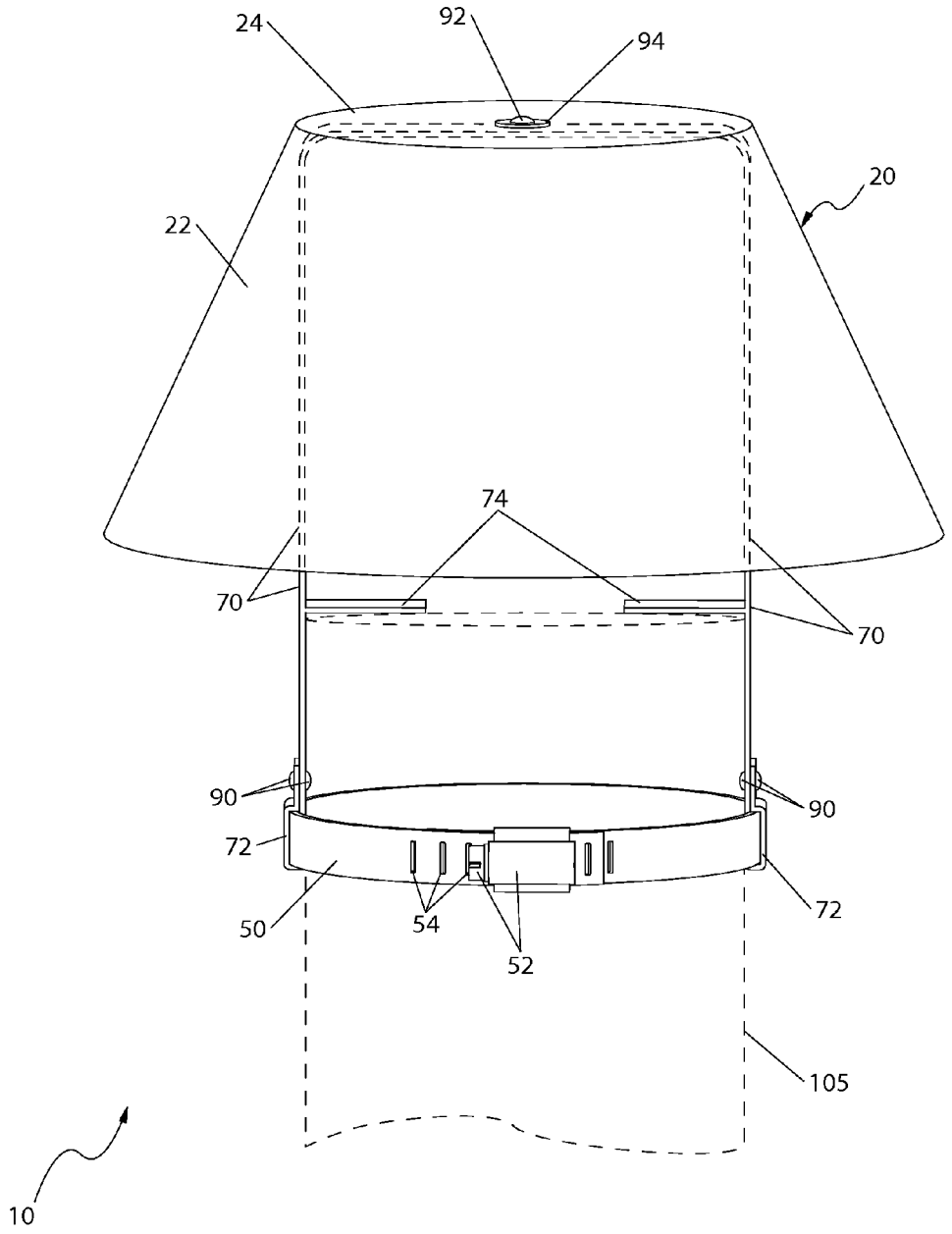
FIG. 2 is a front perspective view of the vent line cap 10 shown in FIG. 1; and, FIG. 3 is an upward-looking view of the vent line cap 10 shown in FIGS. 1 and 2.
Figure 3:
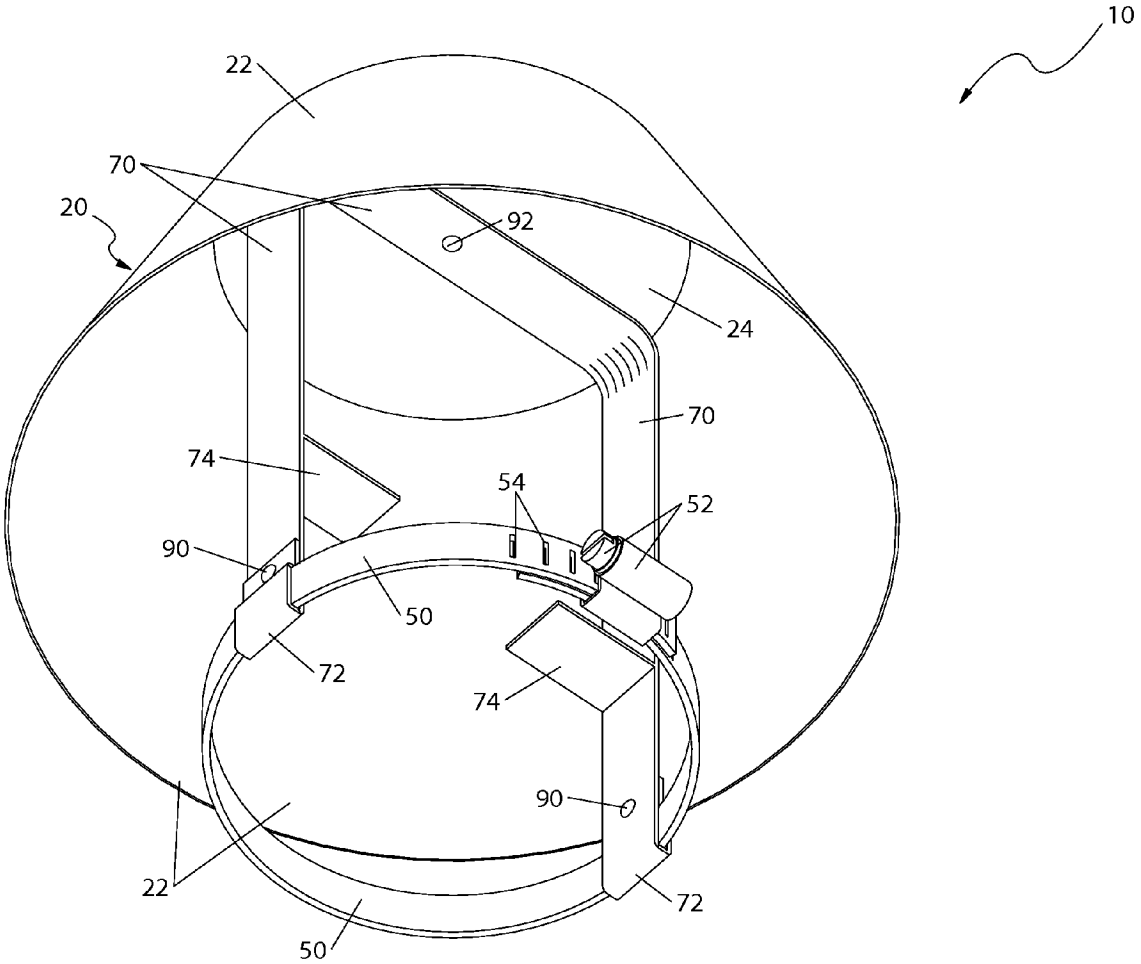

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The principles of the invention provide for a preferred embodiment vent line cap 10 which protects existing sanitary plumbing vent lines from debris while allowing proper operation and easy installation and removal. FIG. 1 shows an environmental view of the vent line cap 10. The vent line cap 10 is placed at the open end of an existing vent line 105, which will usually be near where the vent line 105 exits the roof of a building 100, such as a house, an apartment building, a commercial building, or most other buildings having plumbing. In practice, the vent line cap 10 will be made available in a variety of diameters to properly mate with the outer diameters of various standard vent lines 105.

As shown in FIG. 1 the vent line cap 10 includes a molded shroud assembly 20 and a substantially flat strap clamp 50 that encircles the vent line 105. The strap clamp 50 is used to attach the vent line cap 10 to the vent line 105, beneficially using only common tools and such that the vent line cap 10 is rigidly fixed to the vent line 105, but readily removed if desired. The shroud assembly 20 covers the vent line 105 opening, preventing foreign materials such as twigs, leaves, small animals, birds, or the like from gaining entrance to the vent line 105 and subjacent plumbing while still allowing air to freely enter or exit the vent line 105.

FIG. 2 provides a front perspective view of the vent line cap 10. The vent line cap 10 includes the shroud assembly 20, the strap clamp 50, and a support bracket 70. The shroud assembly 20 has an open-bottomed, cone-segment-shaped cross-section that is formed by an outward flaring side 22 and a generally circular top 24. The top 24 attaches to the top part of the support bracket 70 as described subsequently. Beneficially the shroud assembly 20 is comprised of a molded plastic such as polyvinyl chloride (PVC), fiberglass, a composite plastic, or alternately a metal such as painted, galvanized, or otherwise plated steel, stainless steel, or another corrosion resistant metal. Since the vent line cap 10 is envisioned as being available in a plurality of diameters to mate with different sized vent lines 105, the shroud assembly 20, strap clamp 50, and support bracket 70 should be appropriately dimensioned.

Still referring to FIG. 2 the support bracket 70 is an inverted "U"-shaped unitary structure preferably made from formed, molded, or extruded flat stock material about one-half inch (½ in.) wide. This will provide the required structural strength to withstand high winds and other environmental stresses that the vent line cap 10 may experience. The support bracket 70 has two (2) integral strap hooks 72 that are located at the bottom ends of two (2) side legs 73 of the support bracket 70. Each strap hook 72 is formed into a "U"-shaped appendage having a narrow vertical slot that is dimensioned to receive flat sections of the strap clamp 50. When the strap clamp 50 is in the strap hooks 72 those hooks are closed around the strap clamp 50 using first fasteners 90 such as a rivet, screw, bolt, or the like so as to form a relatively rigid union.

The support bracket 70 further comprises two opposing integral stops 74 that protrude inward from intermediate positions of the two side legs 73. The stops 74 are horizontal appendages approximately one inch (1 in.) in length configured to rest on the top of the vent line 105 so as to vertically position the vent line cap 10 on the vent line 105.

The two (2) side legs 73 continue past the stops 74 to an upper horizontal leg 75 that connects to the two (2) side legs 73, thus completing the inverted "U" shape of the support bracket 70. The top 24 of the shroud assembly 20 is fastened at the center of the upper horizontal leg 75 using at least one (1) second fastener 92 having a washer 94. The second fastener 92 is envisioned as being a rivet, screw, bolt, or the like, while the support bracket 70 is envisioned as being a rugged corrosion resistant material such as stainless steel, composite plastic, or an equivalent material capable of withstanding environmental stresses encountered on a building 100 roof.

FIG. 3 presents an upward-looking view of the vent line cap 10. The strap clamp 50 is routed through the strap hooks 72 of the strap bracket 70. This forms a guided circular clamp suitable for mating with the top of the vent line 105. With the strap clamp 50 routed through the strap hooks 72 the strap clamp 50 can be tightened using a conventional integral screw-type tensioner mechanism 52. The tensioner mechanism 52 engages and works in conjunction with a plurality of parallel vertical apertures 54 formed in the strap clamp 50 to enable tightening around the vent line 105 using a common screw or nut driver.

It is envisioned that many other styles and configurations of the present invention can be easily incorporated into the teachings of the present invention. While only one particular configuration is shown and described it is for purposes of clarity and disclosure and not by way of limitation of scope.

The preferred embodiment of the present invention can be utilized by the common user in a simple and effortless manner with little or no training. After initial purchase or acquisition of the vent line cap 10 it would be installed as suggested in FIG. 1. The method of installing and utilizing the vent line cap 10 may be achieved by performing the following steps: procuring a model of the vent line cap 10 having shroud assembly 20, strap clamp 50, and support bracket 70 which provide an inner diameter suitable for fitting over the outer diameter of an existing vent line 105; loosening the tensioner mechanism 52 using a common driver, if needed; inserting the strap clamp 50 over the end portion of the vent line 105 until the stops 74 of the support bracket 70 contact the top of the vent line 105; tightening the strap clamp 50 around the vent line 105 by rotating the tensioner mechanism 52 to obtain a tight fit with the vent line 105; and, benefiting from prevention of foreign material such as twigs or leaves, from entering the vent line 105 while using the vent line cap 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A vent line cap, comprising:

a shroud assembly having an open-bottomed conical side and a generally circular top;

a substantially flat strap clamp, motionless with respect to a vent line; and, an inverted "U"-shaped support bracket comprising two side legs, each having a bottom strap hook, a horizontally protruding stop above said strap hook, and an upper horizontal leg that spans between said two side legs;

wherein said top attaches to said upper horizontal leg; and, wherein each strap hook is formed into a "U"-shaped appendage having a narrow vertical slot dimensioned to receive and close around flat sections of said strap clamp with a fastener to form a rigid union.

2. The vent line cap according to claim 1, wherein said strap clamp includes an integral screw-type tensioner mechanism and a plurality of parallel apertures for interacting with said screw-type tensioner mechanism.

3. The vent line cap according to claim 1, wherein said shroud assembly is comprised of molded plastic.

4. The vent line cap according to claim 1, wherein said shroud assembly is comprised of corrosion resistant metal.

5. The vent line cap according to claim 1, further including a top fastener connecting said top to said upper horizontal leg.

6. The vent line cap according to claim 5, wherein said top fastener includes a washer.

7. The vent line cap according to claim 2, wherein said screw-type tensioner mechanism is adjustable using a tool selected from a list consisting of a screwdriver, a nut driver, a wrench, a crescent wrench, a lock wrench, and pliers.

8. A vent line cap, comprising:

a shroud assembly having an open-bottomed outward flaring side and a generally circular top;

a substantially flat strap clamp having an integral screw-type tensioner mechanism and a plurality of parallel apertures for interacting with said screw-type tensioner mechanism; and, an inverted "U"-shaped unitary support bracket comprising two side legs, each with a bottom strap hook, a horizontally protruding stop above said strap hook, and an upper horizontal leg that spans between said two side legs;

wherein said top attaches to said upper horizontal leg; and, wherein each strap hook is formed into a "U"-shaped appendage having a narrow vertical slot dimensioned to receive and close around flat sections of said strap clamp with a fastener to form a rigid union.

9. The vent line cap according to claim 8, wherein said shroud assembly, said strap clamp, and said support bracket are dimensioned to attach to a vent line such that said stops rest on top of the vent line.

10. The vent line cap according to claim 8, wherein said screw-type tensioner mechanism is adjustable using a tool selected from a list consisting of a screwdriver, a nut driver, a wrench, a crescent wrench, a lock wrench, and pliers.

* * * * *